US011427377B2

(12) United States Patent
Mardi et al.

(10) Patent No.: US 11,427,377 B2
(45) Date of Patent: Aug. 30, 2022

(54) TEARABLE LEAK-RESISTANT CONTAINER

(71) Applicant: Southern Champion Tray, L.P., Chattanooga, TN (US)

(72) Inventors: Neha Mardi, Chattanooga, TN (US); David Chapman, Chattanooga, TN (US); Doug Ehman, Chattanooga, TN (US)

(73) Assignee: Southern Champion Tray, L.P., Chattanooga, TN (US)

( * ) Notice: Subject to any disclaimer, the term of this patent is extended or adjusted under 35 U.S.C. 154(b) by 0 days.

(21) Appl. No.: 17/145,095

(22) Filed: Jan. 8, 2021

(65) Prior Publication Data

US 2021/0221556 A1 Jul. 22, 2021

Related U.S. Application Data

(60) Provisional application No. 62/958,557, filed on Jan. 8, 2020.

(51) Int. Cl.

| | |
|---|---|
| ***B65D 5/54*** | (2006.01) |
| ***B65D 5/20*** | (2006.01) |
| ***B65D 5/18*** | (2006.01) |
| ***B65D 5/00*** | (2006.01) |

(52) U.S. Cl.

CPC ..... *B65D 5/548* (2013.01); *B65D 5/0015* (2013.01); *B65D 5/18* (2013.01); *B65D 5/2038* (2013.01)

(58) Field of Classification Search

CPC ..... B65D 5/548; B65D 5/0015; B65D 5/18; B65D 5/2038; B65D 81/3453; B65D 5/0209; B65D 75/5888; B65D 77/02; B65D 5/6685; A47G 21/001; A47G 19/03

USPC ..... 229/236, 938, 101.1, 114, 243, 87.08, 229/906; 206/557, 804; 426/115, 122

See application file for complete search history.

(56) References Cited

U.S. PATENT DOCUMENTS

| | | | | |
|---|---|---|---|---|
| 4,325,482 | A * | 4/1982 | Feeser | B65D 5/5435 229/224 |
| 5,507,579 | A * | 4/1996 | Sorenson | B65D 31/10 383/207 |
| 8,631,997 | B2 * | 1/2014 | Millet | A47G 21/001 229/114 |
| 8,820,621 | B2 * | 9/2014 | Burke | B65D 85/36 229/146 |
| 10,589,892 | B2 * | 3/2020 | Van Dijk | B65D 5/4295 |
| 2003/0080120 | A1 * | 5/2003 | Whitmore | B65D 5/029 219/730 |

* cited by examiner

*Primary Examiner* — Christopher R Demeree
(74) *Attorney, Agent, or Firm* — Rockridge Venture Law; Kevin Christopher; Andrew Lerner

(57) ABSTRACT

A tearable leak-resistant container is provided with creases, partial perforation along selected creases, adhesion of flaps, and a collapsed position to permit rapid reconfiguration to an expanded position. The expanded position of the container enables enhanced filling with food ingredients and transportation without spillage. The adhered flaps provide enhanced leak resistance, and the perforated creases permit disassembly of the container to improve access to the food contained within.

21 Claims, 3 Drawing Sheets

TEARABLE LEAK-RESISTANT CONTAINER

CROSS-REFERENCE TO RELATED APPLICATIONS

This application claims priority to U.S. Provisional Patent Application No. 62/958,557 filed Jan. 8, 2020, which application is incorporated herein by reference in its entirety.

BACKGROUND OF THE INVENTION

Field of the Invention

The present invention is directed generally to a tearable container, and more particularly to a stackable, expandable, and leak-resistant tearable container engineered to improve food assembly, storage, accessibility, and consumption.

The present invention is designed for use with tacos, but may be used for gyros, crepes, wraps, and other foods.

Technology in the Field of the Invention

Food assembly, transportation, and consumption can be difficult and messy processes, presenting challenges to both retail food service businesses and food consumers. This is particularly true for foods such as tacos, gyros, crepes, and wraps, which consist of various types of food combinations and configurations. These combinations of ingredients range in liquid content, density, texture, saturation, viscosity, and other characteristics and include edible envelopes designed to contain their interior, enveloped ingredients within a cavity.

The ongoing COVID-19 pandemic has resulted in decreased demand for dine-in meals and greater demand for drive-thru, takeout, and delivery, necessitating innovation in food safety and delivery. As market examples, reservations and walk-ins at OpenTable network restaurants in 2020 were down by 59% from 2019, and e-grocers are expected to grow from 3.4% of the grocery market in 2019 to 10.2% in 2020. The following non-essential publications are incorporated by reference in their entirety to aid in the understanding of innovation in food safety and marketplace trends in off-site dining: Olaimat, A. N., et al. (2020). "Food Safety During and After the Era of COVID-19 Pandemic." Frontiers in Microbiology 11(1854); "Restaurant Experts' 2021 Outlook, Part One," Modern Restaurant Management, https://modernrestaurantmanagement.com/restaurant-experts-2021-outlook-part-one/.

Tacos are one example of enveloped foods experiencing higher demand in limited contact or contactless channels such as drive-thru, takeout, and delivery. According to restaurant industry magazine Technomic, taco offerings on restaurant menus rose 32.4% from 2010 to 2015. According to market research company Technavio, the global packaged tacos market is expected to grow by 5% CAGR from 2017 to 2021, fueled by urbanization.

Enveloped foods are often rapidly assembled, transported, and eaten in bustling, crowded environments. Overfilling of a taco shell, tortilla, pita bread, or other envelope leads to spillage of contents during assembly, transfer, and/or consumption, leading to unprofitable experiences for food preparers and delivery services, and unpleasant experiences for consumers of the product. As many enveloped food products feature ingredients with oils and other liquid contents, even when envelopes are not overfilled their respective consumers typically experience leakage in the form of greasy spillover and residue. Finally, consumers increasingly desire touchless food packaging that prevents contact between their hands and the food envelope.

Presently, many enveloped foods are packaged and presented in paper or foil wrappers. While these wrappers may reduce leakage during transit and may reduce hand contact during food consumption, they typically fail to prevent spillover or messy saturation during consumption and may result in hands coming into contact with food due to their flexible nature. No cost-effective, mass-produced container is specifically designed to address the types of deficiencies highlighted above in preparation, transportation, and consumption.

Accordingly, there is a need for a container designed for stackable storage, rapid expansion for filling, easy food assembly within the container, efficient and spill-free transportation, and accessible, touchless, mess-free consumption of the contained food product.

BRIEF SUMMARY OF THE INVENTION

In a first exemplary container embodying the principles of the present invention, a unitary paperboard blank is creased, partially perforated along selected spine creases, folded along selected creases, and adhered along flaps to overcome the limitations in the art detailed above. Such first exemplary embodiment of the present invention is planar and in a collapsed position to achieve desirable transportation and storage economies. This embodiment of the invention may be rapidly expanded, filled with food items, and transferred to consumers either in a food service location or by a delivery service, minimizing space requirements and maximizing protection of food contents during these processes. Consumers of food products packaged by this embodiment of the invention may more freely and confidently transport the container with its food contents, as well as access the food with minimal spillage or leakage, and can even sit or stand while consuming the food without the need for utensils or touching the food with their hands.

In accordance with the invention, blanks of diverse sizes, shapes, materials, and coatings may be used to manufacture containers of diverse sizes and shapes, within the ambit of the inventive attributes described herein, to meet the needs of various food service industries. In a first exemplary embodiment of the invention, the paperboard blank is composed of standard solid bleached sulfate (SBS). In additional embodiments the paperboard blank is unbleached but alternatively treated to create printable and wet-resistant materials suitable for use in the food service industry. In additional embodiments of the invention, the blank is composed of containerboard, including both linerboard and corrugating medium, which may be double-walled, bleached, or treated and may exhibit alternative fluting sizes and directions. Alternative embodiments may exhibit alternative stiffness-to-weight ratios as well as alternative properties of oil- and grease-resistance, moisture and temperature resistance, printing, texturing, coloring, and sustainability and repulping.

In an exemplary embodiment, two spine creases running parallel along the blank and measuring approximately one inch apart are perforated approximately four-fifths of the way down the spine to facilitate a tearing mechanism of these perforated crease segments. Alternative embodiments within the reasonable limitations and expectations of the invention may include perforated crease segments in a range of one-fourth to the full length of each spine crease. Alternative embodiments may also include parallel perforated crease segments and their corresponding spine creases spaced more than or less than one inch apart, including spacing suitable for tacos, gyros, crepes, wraps, and other foods of diverse shapes and sizes.

In an exemplary embodiment, each perforated crease segment is also notched at the open end of the tearable container, forming an outwardly facing center tab, for easier grip and tearing of the perforation. Alternative embodiments may include: an inwardly facing indention created by the notches; one notch as opposed to two; textured contact points on the center tab, inwardly facing indentation, spine, sides, or some combination of these; tabs or flaps protruding from the spine or the sides flanking the spine, or any other features contributing to the tearing mechanism reasonably anticipated by one skilled in the art.

Furthermore, particular embodiments may optionally include printing on the blank, to include graphical or written descriptions of proper usage including both container expansion at the food service location and container disassembly along perforated crease segments to access the food contents.

In one exemplary embodiment, the blank is shaped in the form of a fan, with rounded edges. Alternative embodiments may include square, zigzag, sinusoidal, irregularly fluctuating, or any other geometry including combinations of these geometries.

The invention is particularly advantageous due to its ease of manufacture. A stack of perforated and pre-creased blanks may be placed in the feed tray of an apparatus for generating collapsed containers from planar blanks by folding and adhering selected regions of the blank. For particular embodiments of the invention, chain and belt mechanisms compress, grasp, and feed individual blanks along an assembly belt, where a register on the machine maintains alignment of each blank through contact with a flat side of the blank. A series of mechanical operations, for example using hooks and rods, folds each blank along perforations and creases. Adhesive is dispensed and blanks are compressed to ensure proper formation of collapsed containers. Containers are conveyed, stacked, and compressed until adhesive is fully dried and containers in their collapsed positions are ready for inspection, shipping, and usage.

It is an object of the present invention to provide a new container and method of container assembly to allow economical and efficient manufacturing, transportation, and storage of containers themselves.

It is another object of the present invention to provide a container engineered for easy, mess-free container expansion, food assembly, and transportation at the retail food service location, as well as leak resistance and touchless ease of access to the food at the point of food consumption.

BRIEF DESCRIPTION OF THE DRAWINGS

The unique attributes of the tearable container are presented in a detailed exemplary embodiment below. Chiefly, the apparatus described in this application is designed for optimal manufacturing, storage, and usage, including enhanced leak resistance and touchless access to food contents within the container. The present invention is not intended to be limited to the subject matter and exemplary embodiments presently disclosed, and modifications and other embodiments that will come to mind to one skilled in the art having the benefit of the teachings presently disclosed are within the scope of this disclosure.

Embodiments of the present invention are better understood from the following detailed description with reference to the following drawings.

DETAILED DESCRIPTION OF CERTAIN EMBODIMENTS

Figure 1:
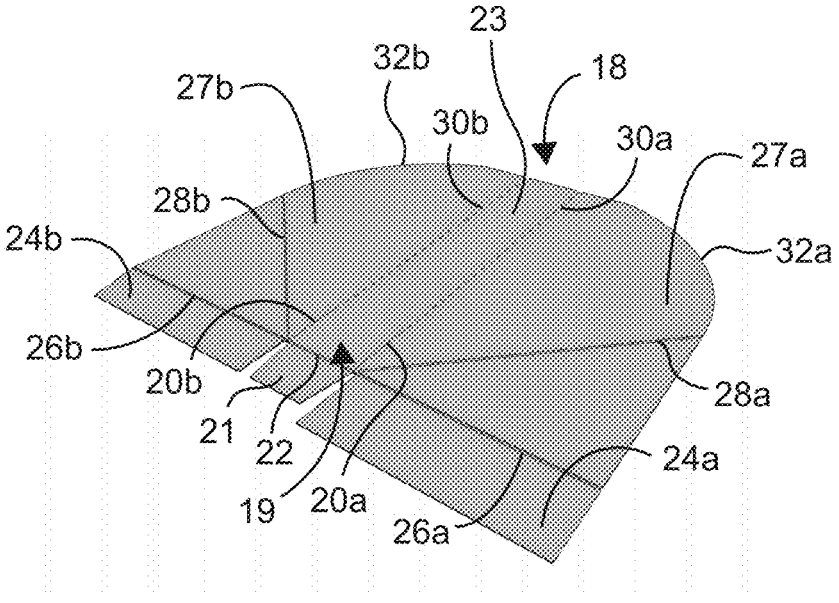
FIG. 1 is a perspective view of an exemplary container in its unfolded planar position.

As depicted in FIG. 1, in an exemplary embodiment the container is in its unfolded planar position. Parallel spine creases 20*a* and 20*b* join bottom spine 23 with sides 27*a* and 27*b*, respectively. Bottom spine 23 includes first end 18 and second end 19. Spine crease 20*a* includes perforated crease segment 30*a* and spine crease 20*b* includes perforated crease segment 30*b*.

Sides 27*a* and 27*b* are bisected by side creases 28*a* and 28*b*. In this embodiment, sides 27*a* and 27*b* exhibit rounded edges 32*a* and 32*b* between their respective perforated crease segments 30*a* and 30*b* and side creases 28*a* and 28*b*. Alternative embodiments anticipated herein may exhibit alternative geometries of edges 32*a* and 32*b*, including square, zigzag, sinusoidal, irregularly fluctuating, some combination of these, or any other geometry.

In this embodiment, perforated crease segments 30*a* and 30*b* extend from first end 18 approximately four-fifths the length of spine creases 20*a* and 20*b*, respectively, leaving one-fifth the length of spine creases 20*a* and 20*b* unperforated toward second end 19. Alternative embodiments anticipated herein include perforated crease segments of various lengths and perforations that are effectively and efficiently designed to modulate tear strength, or resistance to tearing at the perforation when external force is applied beginning at first end 18 to rupture the perforation. Alternative embodiments include perforated crease segments longer than and shorter than four-fifths the length of their respective spine creases, including a range of lengths of perforated crease segments from at least one-fourth the length of their respective spine creases to a length equivalent to the length of their respective spine creases. Alternative embodiments anticipated herein include perforated crease segments 30*a* and 30*b* exhibiting perforations of any dimension or pattern compatible with the preferred substrate, including micro or coarse perforations with alternative ties per inch, cut/tie sizes, tooth sizes, or any other arrangements and geometries to modulate burst and tear strengths.

Herein, perforated crease segments 30*a* and 30*b* are depicted approximately one inch apart. Alternative embodiments anticipated herein include distances between perforated crease segments 30*a* and 30*b* greater than or less than one inch in order to modulate ease of container expansion, shape of the expanded position, efficiency of disassembly/tearing, intended use, or any combination of these.

End creases 26*a* and 26*b* join end flaps 24*a* and 24*b*, respectively, with sides 27*a* and 27*b*, respectively. Bottom crease 22 joins bottom flap 21 with bottom spine 23. In this embodiment, side crease 28*a* bisects side 27*a* to form a 45-degree angle between side crease 28*a* and spine crease 20*a* and a 45-degree angle between side crease 28*a* and end crease 26*a*. Similarly, side crease 28*b* bisects side 27*b* to form a 45-degree angle between side crease 28*b* and spine crease 20*b* and a 45-degree angle between side crease 28*b* and end crease 26*b*. Alternative embodiments anticipated herein may feature different angles between creases 28*a* and 28*b* and the other creases along their respective sides 27*a* and 27*b*. In this embodiment, creases are deep and narrow, resulting in low folding resistance and accurate folding operations. Alternative embodiments of the present invention anticipated herein include creases of varying width, depth, patterning, orientation to the paperboard fiber direction, and combinations thereof to optimize the creasing operation to facilitate folding operations. Alternative embodiments anticipated herein may feature diverse bottom flap sizes, shapes, and geometries, including wings or tabs.

Figure 2:
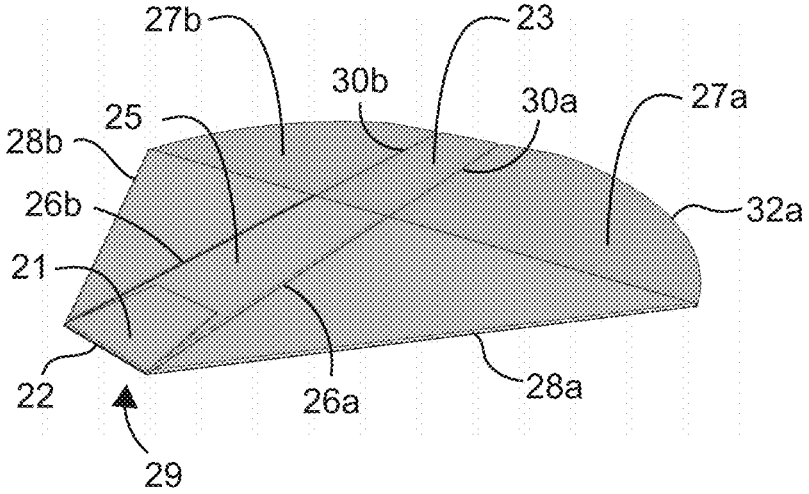
FIG. 2 is a perspective view of the container of FIG. 1 in its collapsed position where some elements have been folded and adhered.

In FIG. 2, the embodiment of FIG. 1 has been reconfigured to its collapsed position by folding and adhering some elements. All elements of the container remain coplanar with the container bottom spine 23 and the container remains collapsed. Sides 27*a* and 27*b* are folded along the side creases 28*a* and 28*b*, respectively, such that end flap 24*a* overlaps and is adhered to end flap 24*b* with any bonding agent demonstrated effective in the food container industry. The overlapping of end flap 24*b* with 24*a* and subsequent adhering of the same forms closed end 25, and bottom flap 21 is folded along crease 22 to overlap and adhere to closed end 25 with a bonding agent. The joining and adhering of end flaps 24*a* and 24*b* and bottom flap 21 generate corner 29, a region of the container designed for leak resistance. Alternative embodiments of the present invention anticipated herein may exhibit varied ordering of layering and adhering overlapping end flaps 24*a*, 24*b*, and bottom flap 21 to generate corner 29.

Figure 3A:
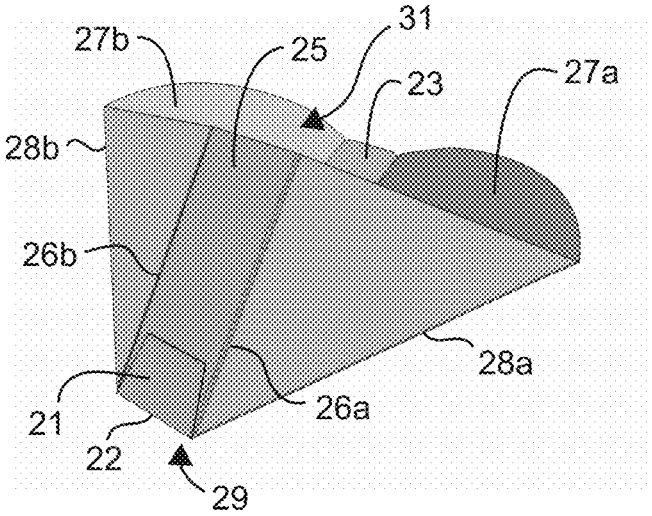
FIG. 3A is a perspective view of the container of FIG. 2 showing partial folding and unfolding along various creases to expand the container from the collapsed position.
Figure 3B:
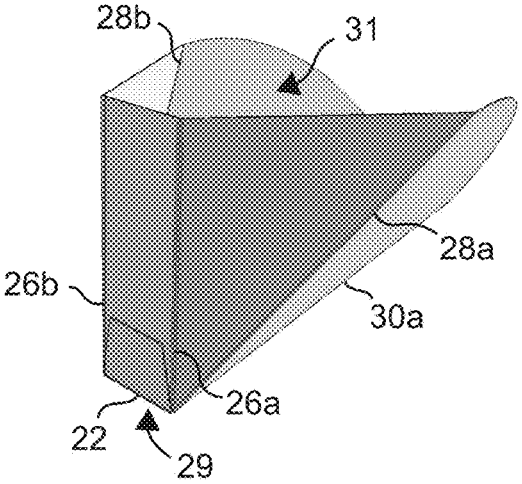
FIG. 3B is a perspective view of the container of FIG. 3A showing further partial folding and unfolding along various creases to further expand the container from the collapsed position.

Referring now to FIGS. 3A and 3B, the embodiment of FIG. 2 is compressed along sides 27*a* and 27*b* to reconfigure the container from the collapsed position to the expanded position. As force is applied, the container folds along spine creases 20*a* and 20*b* as well as end creases 26*a* and 26*b*, while the container unfolds along bottom crease 22 and side creases 28*a* and 28*b*. Bottom spine 23 is the only element remaining in its original plane as all other elements are reconfigured to generate interior cavity 31.

Figure 3C:
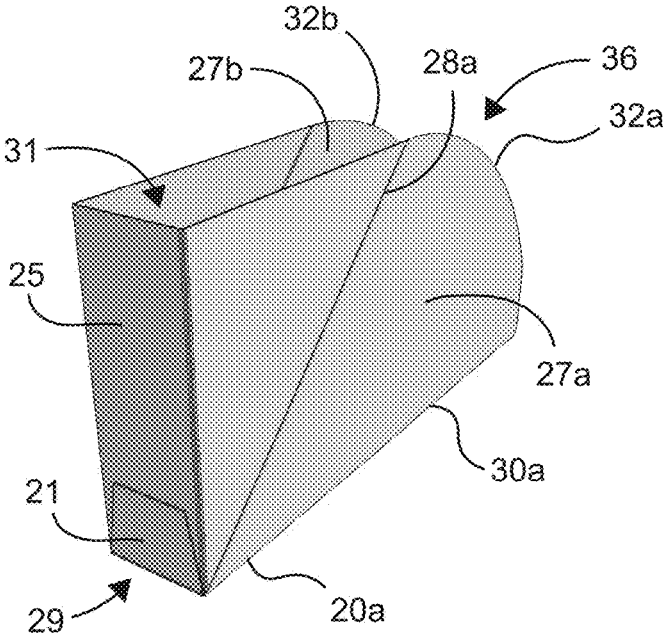
FIG. 3C is a perspective view of the container of FIG. 3B after it has been optimally unfolded and folded to expand the container from its collapsed position depicted in FIG. 2 to its expanded position ready for use.

As depicted in FIG. 3C, the embodiment of FIG. 2 is configured in its expanded position upon completion of the reconfiguration shown in FIGS. 3A and 3B, generating interior cavity 31. Spine creases 20*a* and 20*b* as well as side creases 26*a* and 26*b* are folded optimally while bottom crease 22 and side creases 28*a* and 28*b* are unfolded optimally. Sides 27*a* and 27*b* and bottom flap 21 are folded substantially perpendicular relative to bottom spine 23, end flaps 24*a* and 24*b* are folded substantially perpendicular relative to sides 27*a* and 27*b*, and sides 27*a* and 27*b* are unfolded along the side creases 28*a* and 28*b*, respectively, forming open end 36 and interior cavity 31.

Figure 4:
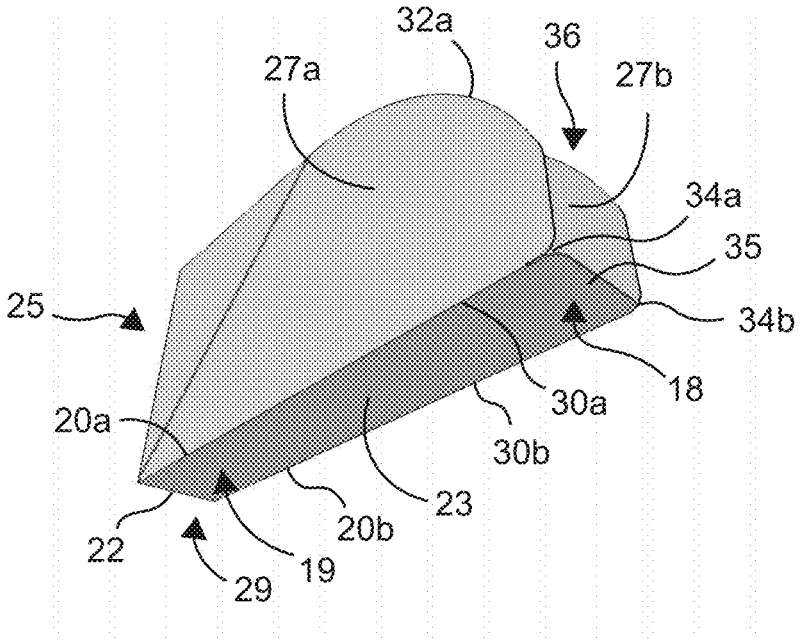
FIG. 4 is a perspective view of the container of FIG. 3C showing the sides and bottom spine designed for ease of disassembly along perforated creases.
Figure 5:
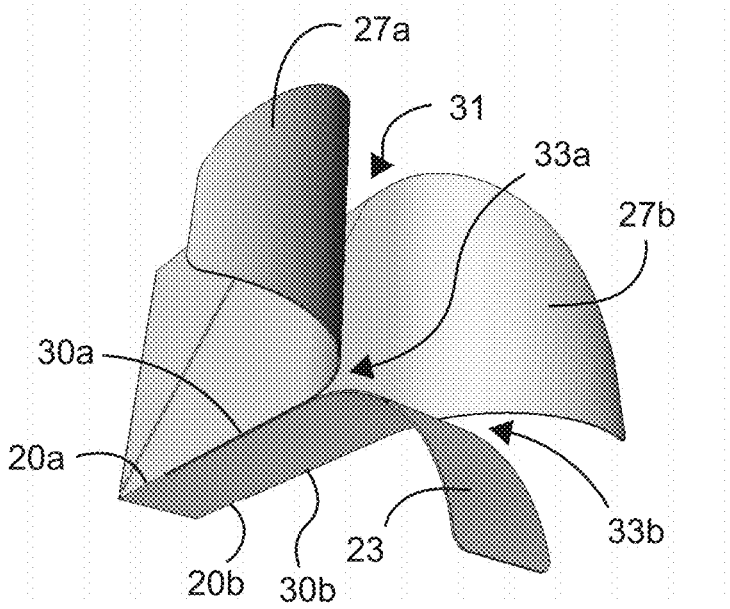
FIG. 5 is a perspective view of the container of FIG. 4 showing the sides and bottom spine in a partially disassembled position for enhanced accessibility.

Referring now to FIGS. 4 and 5, the embodiment depicted in FIG. 3C is rotated to show open end 36 and the function of perforated crease segments 30*a* and 30*b* along spine creases 20*a* and 20*b*, respectively, to increase access to interior cavity 31. Consumers of food products packaged by this embodiment of the invention may grip side 27*a*, side 27*b*, bottom spine 23 at center tab 35, or some combination of these to exert bending force that facilitates a tearing mechanism of perforated crease segments 30*a* and 30*b* initiating at the first end 18 of the bottom spine. In this exemplary embodiment, perforated crease segments 30*a* and 30*b* include notches 34*a* and 34*b*, respectively, forming center tab 35 for easier grip that facilitates tearing of the perforations beginning at first end 18. Alternative embodiments may include notches, tabs, flaps, textured contact points, indentations, grooves, some combination of these, or other features on the spine or sides at first end 18 or open end 36 to contribute to rupture of perforations and tearing along spine creases.

Referring to FIG. 5, as bending force away from interior cavity 31 is applied to side 27*a*, side 27*b*, bottom spine 23, or a combination of these, perforated crease segment 30*a*, perforated crease segment 30*b*, or both perforated crease segments 30*a* and 30*b* tear along their perforations. In particular, when external bending force is applied in order to separate side 27*a* from bottom spine 23, rupturing perforations 33*a* along perforated crease segment 30*a* facilitate tearing along spine crease 20*a* to the point where perforated crease segment 30*a* ends. Similarly, when external bending force is applied in order to separate side 27*b* from bottom spine 23, rupturing perforations 33*b* along perforated crease segment 30*b* facilitate tearing along spine crease 20*b* to the point where perforated crease segment 30*b* ends. These bending and tearing operations allow separation of side 27*a* from bottom spine 23, separation of side 27*b* from bottom spine 23, or separation of both sides 27*a* and 27*b* from bottom spine 23, disassembling the container to permit easier access to interior cavity 31. Tearing of perforated crease segments 30*a* and 30*b* along spine creases 20*a* and 20*b*, respectively, to the point where perforated crease segments 30*a* and 30*b* end results in a disassembled position, and partial tearing up to the point where perforated crease segments 30*a* and 30*b* end results in a partially disassembled position.

In alternative embodiments of the present invention, a method may include providing a perforated and pre-creased blank made of a foldable substrate as depicted in FIG. 1, folding the blank into a container in a collapsed position as depicted in FIG. 2, and compressing and drying the collapsed container. The method may include reconfiguring the collapsed container into an expanded position as depicted in FIGS. 3A-3C or filling the container in its expanded position with food. The method may also include disassembling the filled container as depicted in FIG. 5 and accessing food contained within the interior cavity.

The representative embodiments described in detail herein have been presented by way of example and not by way of limitation. It will be understood by those skilled in the art that changes may be made in the form and details of the described embodiments resulting in equivalent embodiments that remain within the scope of the appended claims.

We claim:

1. A tearable container comprising:

a bottom spine, wherein the bottom spine comprises a first end and a second end;

a first side foldably attached to the bottom spine by a first spine crease;

a second side foldably attached to the bottom spine by a second spine crease, wherein said second spine crease is parallel to the first spine crease;

an open end, wherein the first end of the bottom spine is located at the open end;

a bottom flap foldably attached to the second end of the bottom spine by a bottom crease;

a first end flap foldably attached to the first side by a first end crease; and a second end flap foldably attached to the second side by a second end crease, wherein the bottom spine is defined by the first end of the bottom spine, the second end of the bottom spine, the first spine crease, and the second spine crease, and wherein the first and second spine creases comprise perforated crease segments.

2. The tearable container of claim 1, wherein each perforated crease segment comprises a notch at the first end of the bottom spine, forming a center tab at the open end.

3. The tearable container of claim 2, wherein the size and shape of each notch and the center tab are modulated to facilitate a tearing mechanism along the perforated crease segments.

4. The tearable container of claim 1, wherein each side comprises a side crease, wherein a collapsed position is planar, and wherein the collapsed position comprises the pair of sides folded along the side creases, the bottom flap folded along the bottom crease, and the end flaps adhered to the bottom flap and fully overlapping and adhered to each other, forming a closed end and a corner of the container.

5. The tearable container of claim 4, wherein an expanded position comprises the pair of sides and the bottom flap folded substantially perpendicular relative to the bottom spine, the pair of end flaps folded substantially perpendicular relative to each side, and the pair of sides unfolded along each side crease, forming the open end and an interior cavity defined by the bottom spine, the closed end, and the sides.

6. The tearable container of claim 5, wherein the distance between spine creases is modulated to optimize the shapes of the bottom spine and the interior cavity.

7. The tearable container of claim 5, wherein the perforated crease segments extend at least one-fourth the length of each spine crease from the first end of the bottom spine.

8. The tearable container of claim 5, wherein the lengths and perforation parameters of the perforated crease segments are modulated to optimize a tearing mechanism along said perforated crease segments.

9. The tearable container of claim 5, wherein a disassembled position comprises the bottom spine and pair of sides bent away from the interior cavity at the open end, and wherein perforations along the pair of perforated crease segments are ruptured.

10. The tearable container of claim 1 wherein the container is made of paperboard that includes printed graphical or written descriptions of proper container usage.

11. A tearable container comprising:

a bottom spine, wherein the bottom spine comprises a first end and a second end;

a first side foldably attached to the bottom spine by a first spine crease;

a second side foldably attached to the bottom spine by a second spine crease, wherein said second spine crease is parallel to the first spine crease;

an open end, wherein the first end of the bottom spine is located at the open end;

a bottom flap foldably attached to the second end of the bottom spine by a bottom crease;

a first end flap foldably attached to the first side by a first end crease; and a second end flap foldably attached to the second side by a second end crease, wherein the bottom spine is defined by the first end of the bottom spine, the second end of the bottom spine, the first spine crease, and the second spine crease, wherein the first and second spine creases comprise perforated crease segments extending from the first end toward the second end of the bottom spine, wherein each perforated crease segment comprises a notch at the first end of the bottom spine forming a center tab at the open end, wherein the size and shape of each notch and said center tab and the perforation parameters of the perforated crease segments are modulated to optimize a tearing mechanism along said perforated crease segments.

12. The tearable container of claim 11, wherein each side comprises a side crease, wherein a collapsed position is planar, and wherein the collapsed position comprises the pair of sides folded along the side creases, the bottom flap folded along the bottom crease, and the end flaps adhered to the bottom flap and fully overlapping and adhered to each other so that a closed end and a corner of the container are formed.

13. The tearable container of claim 12, wherein an expanded position comprises the pair of sides and the bottom flap folded substantially perpendicular relative to the bottom spine, the pair of end flaps folded substantially perpendicular relative to each side, and the pair of sides unfolded along each side crease, forming the open end and an interior cavity defined by the bottom spine, the closed end, and the sides.

14. The tearable container of claim 13, wherein the distance between spine creases is modulated to optimize the shapes of the bottom spine and interior cavity.

15. The tearable container of claim 13, wherein the size and shape of the sides and bottom spine are modulated at the open end to optimize the tearing mechanism.

16. The tearable container of claim 13, wherein a disassembled position comprises the bottom spine and pair of sides bent away from the interior cavity at the open end, and wherein perforations along the pair of perforated crease segments are ruptured.

17. A method comprising:

providing a perforated and pre-creased blank made of a foldable substrate, the blank being of the type having:

a bottom spine, wherein the bottom spine comprises a first end and a second end;

a first side foldably attached to the bottom spine by a first spine crease and comprising a first side crease;

a second side foldably attached to the bottom spine by a second spine crease and comprising a second side crease, wherein said second spine crease is parallel to the first spine crease;

an open end, wherein the first end of the bottom spine is located at the open end;

a bottom flap foldably attached to the second end of the bottom spine by a bottom crease;

a first end flap foldably attached to the second end of the bottom spine by a bottom crease;

a first end flap foldably attached to the first side by a first end crease; and a second end flap foldably attached to the second side by a second end crease, wherein the bottom spine is defined by the first end of the bottom spine, the second end of the bottom spine, the first spine crease, and the second spine crease, wherein the first and second spine creases comprise perforated crease segments extending from the first end toward the second end of the bottom spine, wherein each perforated crease segment comprises a notch at the first end of the bottom spine forming a center tab at the open end, wherein the size and shape of each notch and said center tab and the perforation parameters of the perforated crease segments are modulated to optimize a tearing mechanism along said perforated crease segments; and folding the blank into a container in a planar collapsed position by folding the pair of sides along the side creases, folding the bottom flap along the bottom crease, adhering overlapping end flaps to each other, and adhering the bottom flap to the overlapping end flaps so that a closed end and a corner of the container are formed.

18. The method of claim 17 wherein the substrate is paperboard.

19. The method of claim 17 further comprising reconfiguring the planar collapsed container into an expanded position by folding the pair of sides and the bottom flap substantially perpendicular relative to the bottom spine, folding the pair of end flaps substantially perpendicular relative to each side, and unfolding the pair of sides along each side crease to form the open end and an interior cavity defined by the bottom spine, closed end, and sides.

20. The method of claim 19 further comprising filling the container in its expanded position with food.

21. The method of claim 20 further comprising:

disassembling the filled container by bending the bottom spine and pair of sides away from the interior cavity at the open end, rupturing perforations along the pair of perforated crease segments; and accessing food contained within the interior activity.

* * * * *